US005339470A

United States Patent [19]

Shamie

[11] Patent Number: 5,339,470

[45] Date of Patent: Aug. 23, 1994

[54] COMBINATION FOLDABLE PLAYPEN AND DRESSING/CHANGING TABLE

[76] Inventor: Louis Shamie, 972 Dean St., Brooklyn, N.Y. 11212

[21] Appl. No.: 54,881

[22] Filed: Apr. 29, 1993

Related U.S. Application Data

[63] Continuation-in-part of Ser. No. 868,452, Apr. 14, 1992, Pat. No. 5,243,718.

[51] Int. Cl.[5] ..... A47D 7/00

[52] U.S. Cl. ..... 5/98.1; 5/99.1; 5/93.2

[58] Field of Search ..... 5/93.1, 93.2, 97, 98.1, 5/99.1

[56] References Cited

U.S. PATENT DOCUMENTS

| | | | |
|---|---|---|---|
| 485,081 | 10/1892 | Baird | 5/99.1 X |
| 2,493,181 | 1/1950 | Andersen, Jr. | 5/98.1 |
| 2,553,087 | 5/1951 | Hanson | 5/93.1 |
| 3,078,478 | 2/1963 | Sheahan | 5/93.1 |
| 3,644,947 | 2/1972 | Padera | 5/93.1 X |
| 4,967,432 | 11/1990 | Kujawski et al. | 5/98.1 |
| 5,163,191 | 11/1992 | Chan | 5/98.1 |

*Primary Examiner*—Michael F. Trettel

*Attorney, Agent, or Firm*—Burgess, Ryan and Wayne

[57] ABSTRACT

A combination playpen and dressing/changing table, includes a frame including an upper frame assembly, a lower frame assembly, a plurality of corner legs, each leg having an upper end and a lower end, and connecting means for interconnecting the upper frame assembly to the upper ends of the corner legs and for interconnecting the lower frame assembly to the lower ends of the corner legs; a fabric enclosure secured to the frame to define a bottom and sides of the playpen; a fabric support surface for supporting an infant thereon; opposite zipper arrangements for removably securing the fabric supporting surface between opposite sides of the playpen such that the fabric supporting surface is positioned above the bottom and below the upper frame assembly.

6 Claims, 9 Drawing Sheets

COMBINATION FOLDABLE PLAYPEN AND DRESSING/CHANGING TABLE

This application is a continuation-in-part of U.S. patent application Ser. No. 07/868,452, filed Apr. 14, 1992, entitled FOLDABLE PLAYPEN, now U.S. Pat. No. 5,243,718, to the same inventor herein.

BACKGROUND OF THE INVENTION

The present invention relates generally to playpens and more particularly, is directed to a playpen that can be converted to a dressing and changing table for an infant.

Foldable playpens of the type disclosed in U.S. Pat. Nos. 4,703,525 and 4,811,437, as well as the foldable playpen disclosed in U.S. patent application Ser. No. 07-868,452, the entire disclosures of all of the above being incorporated herein by reference, are well known in the art. Such playpens can be folded into a small space for easy storage and transport and are therefore convenient items for use by mothers on the move.

However, although such playpens are collapsible for easy and compact transportation, it stills remains inconvenient to dress a baby and/or change a baby's diaper outside of the home. As a result, parents generally dress and/or change a baby's garments on top of a bed, table or the like which does not have the safety necessary for the baby, for example, in the event that the parent becomes distracted by an unexpected incident, the baby is left in a dangerous situation.

OBJECTS AND SUMMARY OF THE INVENTION

Accordingly, it is an object of the present invention to provide a combination playpen and dressing/changing table that overcomes the problems with the aforementioned prior art.

It is another object of the present invention to provide a combination playpen and dressing/changing table that uses a foldable playpen, as modified, as the dressing/changing table.

It is still another object of the present invention to provide a combination that can be used either as a playpen or a dressing/changing table.

It is yet another object of the present invention to provide a combination playpen and/or dressing/changing table that is compact and easily portable.

It is a further object of the present invention to provide a combination playpen and dressing/changing table that is easy and economical to manufacture and use.

In accordance with an aspect of the present invention, a combination playpen and dressing/changing table, includes a frame including an upper frame assembly, a lower frame assembly, a plurality of corner legs, each leg having an upper and a lower end, and connecting means interconnecting the upper frame assembly to the upper ends of the corner legs and for interconnecting the lower frame assembly to the lower ends of the corner legs; a fabric enclosure secured to the frame to define a bottom and sides of the playpen; supporting surface means for supporting an infant thereon; and securing means for removably securing the supporting surface means between opposite sides of the playpen such that the supporting surface means is positioned above the bottom and below the upper frame assembly, Preferably, the supporting surface means is constituted by a fabric sheet having a set of interlocking teeth thereon, with a slide fastener slidably mounted on each set of interlocking teeth. Opposite sides of the fabric enclosure each include a second set of interlocking teeth for engaging with a respective set of teeth on the fabric support in order to removably secure the fabric support between opposite sides of the playpen such that the fabric support is positioned above the bottom and below the upper frame assembly.

The fabric support may additionally and/or alternatively be supported by other means such as straps secured to the upper frame assembly and/or corner legs which are removably attachable to the fabric support.

The above and other objects, features and advantages of the present invention will become readily apparent from the following detailed description thereof which is to be read in connection with the accompanying drawings.

DETAILED DESCRIPTION OF THE PREFERRED EMBODIMENTS

Figure 1:
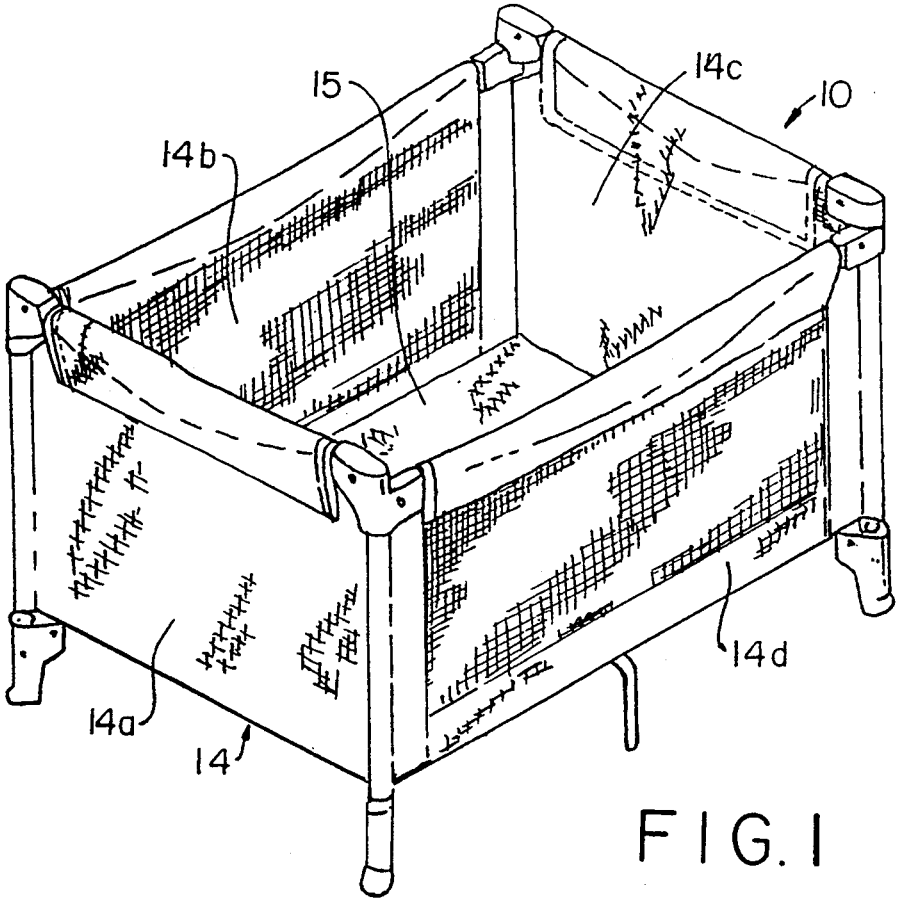
FIG. 1 is a top perspective view of a combination playpen and dressing/changing table according to the present invention.

Referring to the drawings in detail, and initially to FIGS. 1–3, a combination playpen and dressing/changing table 10 according to the present invention includes a frame 12 and a fabric enclosure 14 secured to frame 12 in a manner to be described hereinafter. Frame 12 basically includes an upper frame assembly 16, a lower frame assembly 18 and a plurality of corner legs 20 which maintain upper frame assembly 16 and lower frame assembly 18 and a horizontally oriented, parallel, spaced apart relation in the open configuration, shown in FIGS. 1–3.

Figure 3:
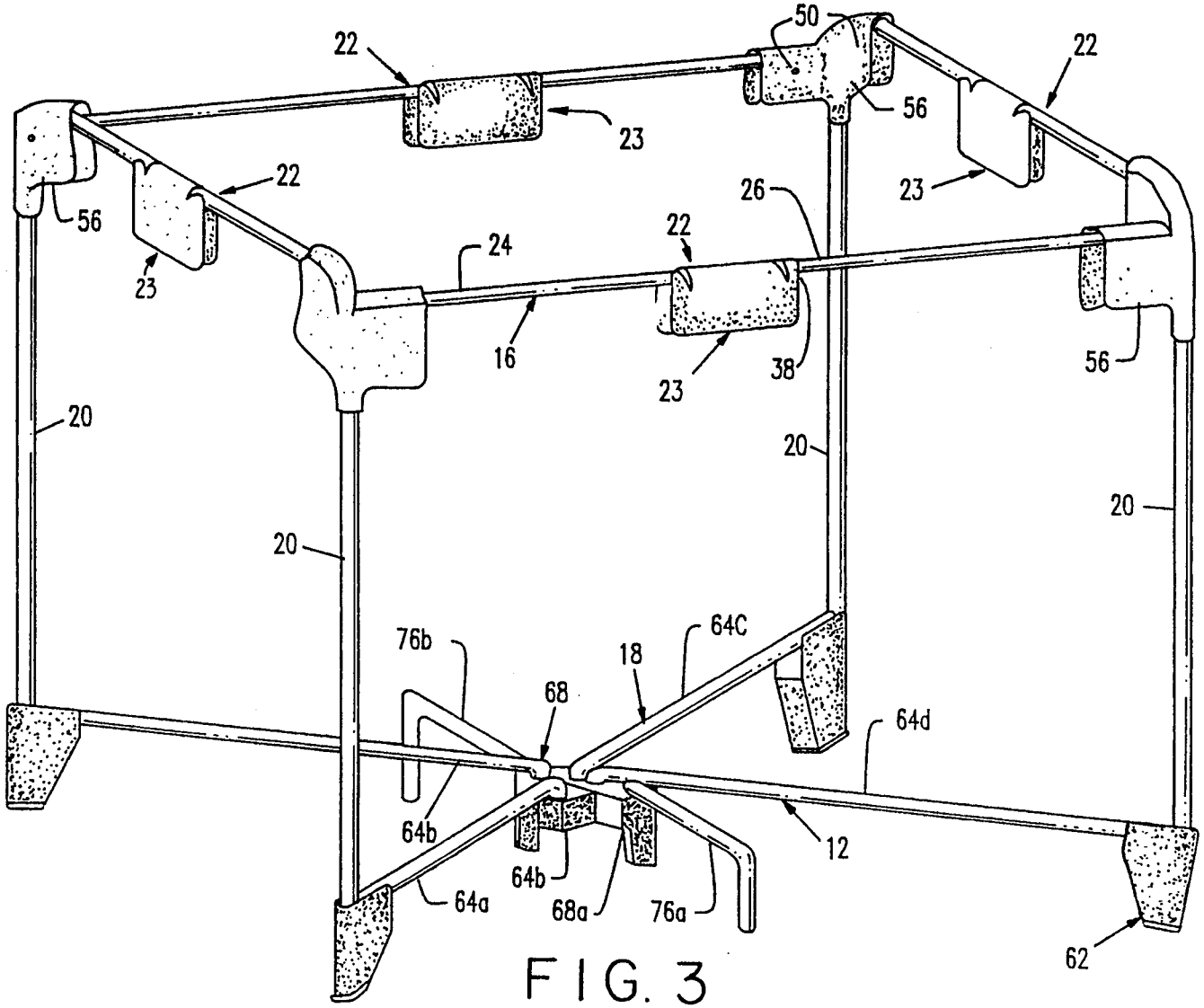
FIG. 3 is a perspective view of the frame of the combination of FIG. 1 in its fully opened configuration.

Upper frame assembly 16 includes a plurality of collapsible upper rails 22 and securing means 23 for releasably maintaining upper rails 22 in the non-collapsed position of FIG. 3. Specifically, there are four upper rails 22, each formed by a first rail section 24 and the second rail section 26. The adjacent ends of rail sections 24 and 26 of each upper rail 22 are pivotally connected with one securing means 23.

The particular construction of each securing means 23 does not form part of the invention and will not be described herein, except that the disclosure thereof in co-pending U.S. patent application No. 07/868,452 is incorporated herein by reference. Securing means 23 permit upper rails 22 to collapse to the intermediate position of FIG. 5 and the closed, storage position of FIG. 6.

Figure 4:
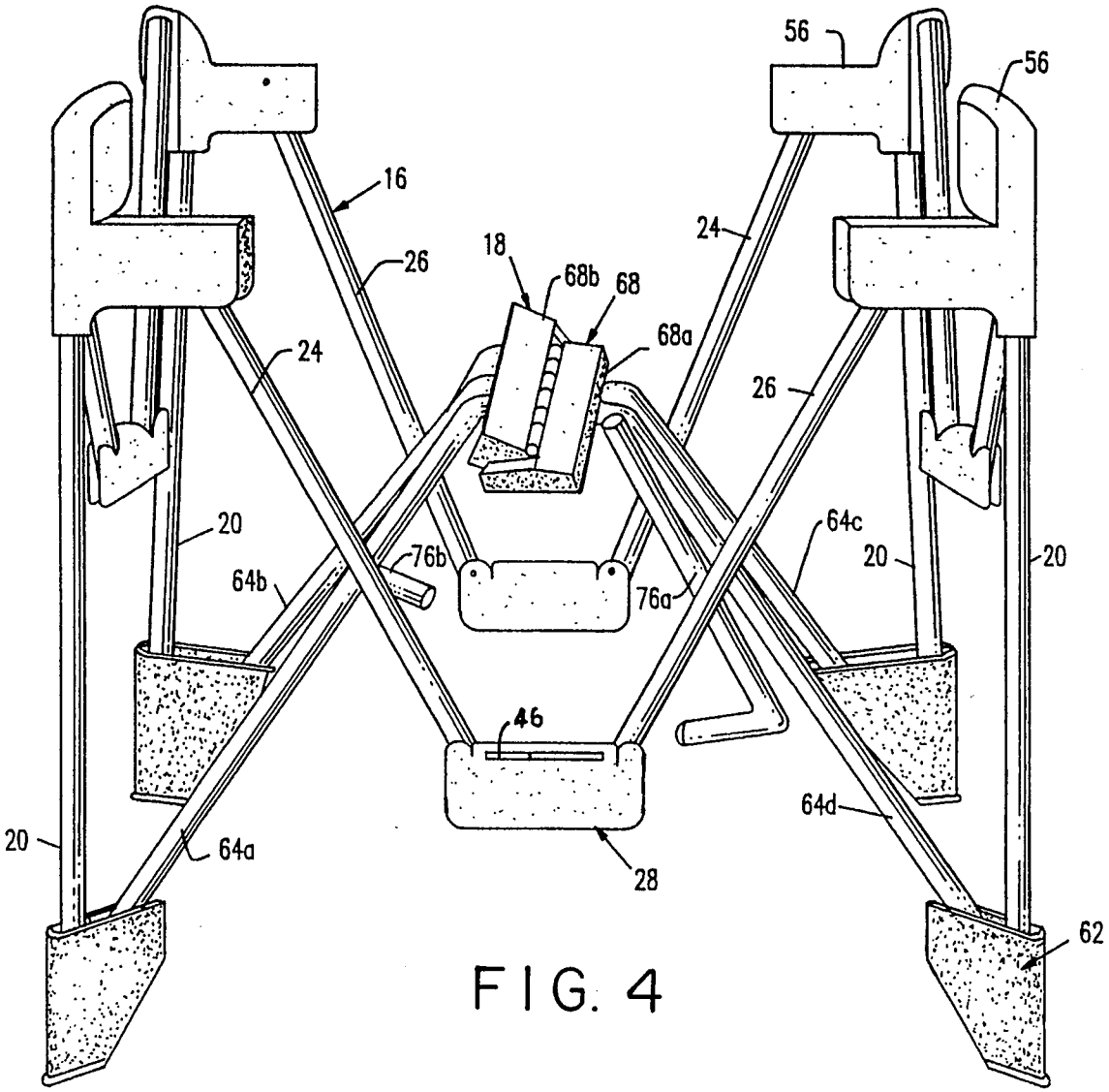
FIG. 4 is a perspective view of the frame of FIG. 3 in its partially closed configuration.

The opposite free ends of rails 24 and 26 are pivotally connected to upper corner connector elements 56, shown in FIG. 4.

Four vertically oriented corner legs 20 are provided, with the upper end of each leg 20 being fitted within 1 connector element 56. The lower end of each leg 20 fits within a lower corner connector element 62.

A lower frame 18 is provided with four lower floor support rails 64*a*–64*d*, each rail 64*a*–64*d* having an outer end pivotally connected within a respective lower corner connector element 62. Accordingly, rails 64*a*–64*d* extend inwardly toward the center of playpen 10 along the horizontal plane.

Figure 5:
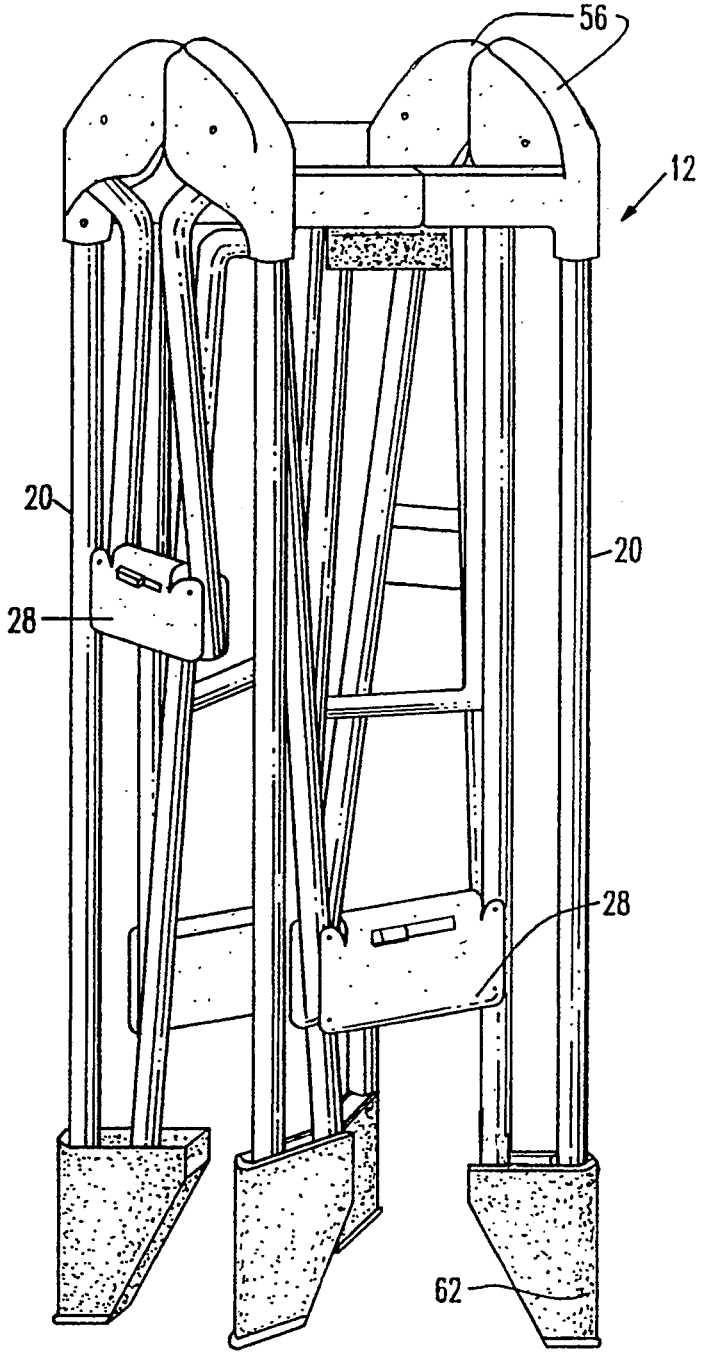
FIG. 5 is a perspective view of the frame of FIG. 3 in its fully closed configuration.

Lower frame 18 further includes a central hub 68 to which the inner ends rails 64*a*–64*d* are connected. Specifically, central hub 68 includes a first hub section 68*a*, a second hub section 68*b* and a hinge assembly 68*c* for hingeably connecting first hub section 68*a* to second hub section 68*b* for relative movement in a vertical plane, as shown in FIGS. 3–5. The bent inner ends of rails 64*a*–64*d* are positioned within first and second hub sections 68*a* and 68*b*, respectively, so that the bent inner ends of rails 64*a*–64*d* are pivotally movable in a horizontal plane that is, the plane transverse to the movement a first hub section 68*a* with respect to second hub section 68*b*.

In addition, auxiliary lower floor support legs 76*a* and 76*b* are provided, each fixedly secured to hub sections 68*a* and 68*b*, respectfully, such that auxiliary lower floor support legs 76*a* and 76*b* extend in a horizontal plane in the open configuration of the combination 10, as shown in FIG. 3. Auxiliary lower floor support legs 76*a* and 76*b* generally bisect the angle between rails 64*a* and 64*c*, and between rails 64*b* and 64*d*, respectfully. Further, lower floor support legs 76*a* and 76*b* of downturned or bent free ends that rest upon a-surface to provide support for the combination 10 when the ladder is opened to the position shown in FIG. 3.

In order to close frame 12, from the position shown in FIG. 3 to the position shown in FIG. 5, release slides 46 of securing means 23 are slid in the opening direction, the corresponding rails 24 and 26 are pivoted to the position shown in FIG. 4. Such movement, lower floor support rails 64*a* and 64*b* pivot toward each other, and lower floor support rails 64*c* and 64*d* pivot toward each other. Then, hub sections 68*a* and 68*b* are pivoted about hinge assembly 68*c*, also to the position shown in FIG. 4. Thereafter, with continued pivotal movement of the various elements, it is obvious from FIG. 4, frame 12 is to close to the position of FIG. 5. To open frame 12, the reverse operation is performed.

As discussed above, a fabric enclosure 14 is provided around frame 12, and does not hinder the aforementioned opening and closing of frame 12. Fabric enclosure 14 includes four side panels 14*a*–14*d*, each side panel being connected between adjacent vertically oriented corner legs 20 and with a collapsible upper rail 22. In addition, a bottom panel 14*e* is connected to the lower edges of side panels 14*a*–14*d* as positioned above lower floor support rails 64*a*–64*d* so as to be supported thereby. Further, each auxiliary lower floor support legs 76*a* and 76*b* are fastened to the underside of bottom panel 14*e* by a fabric tab 14*f*.

Figure 2:
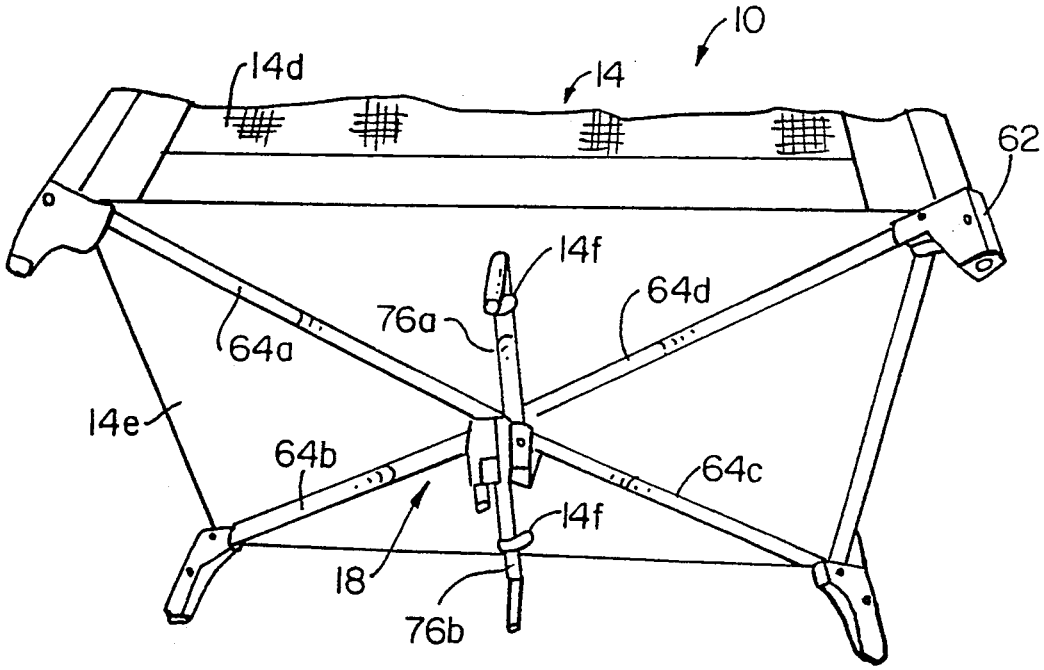
FIG. 2 is a bottom perspective view of the combination playpen and dressing/changing table of FIG. 1.

In addition, a substantially rectangular foldable floormat 15 is provided for insertion on top of bottom panel 14*e* in the open configuration of FIG. 1.

Figure 6:
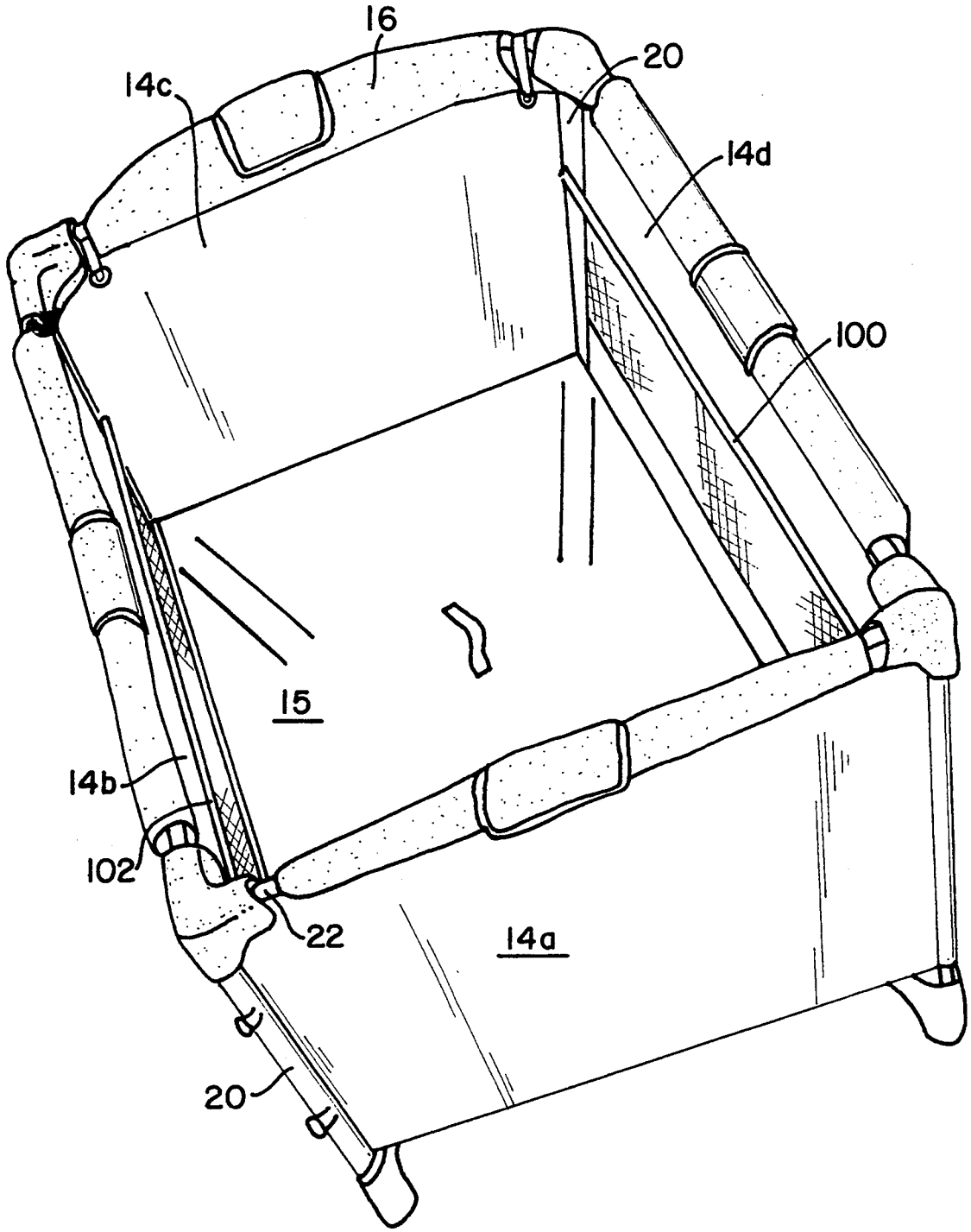
FIG. 6 is a perspective view similar to FIG. 1 showing the combination used as a playpen.
Figure 7:
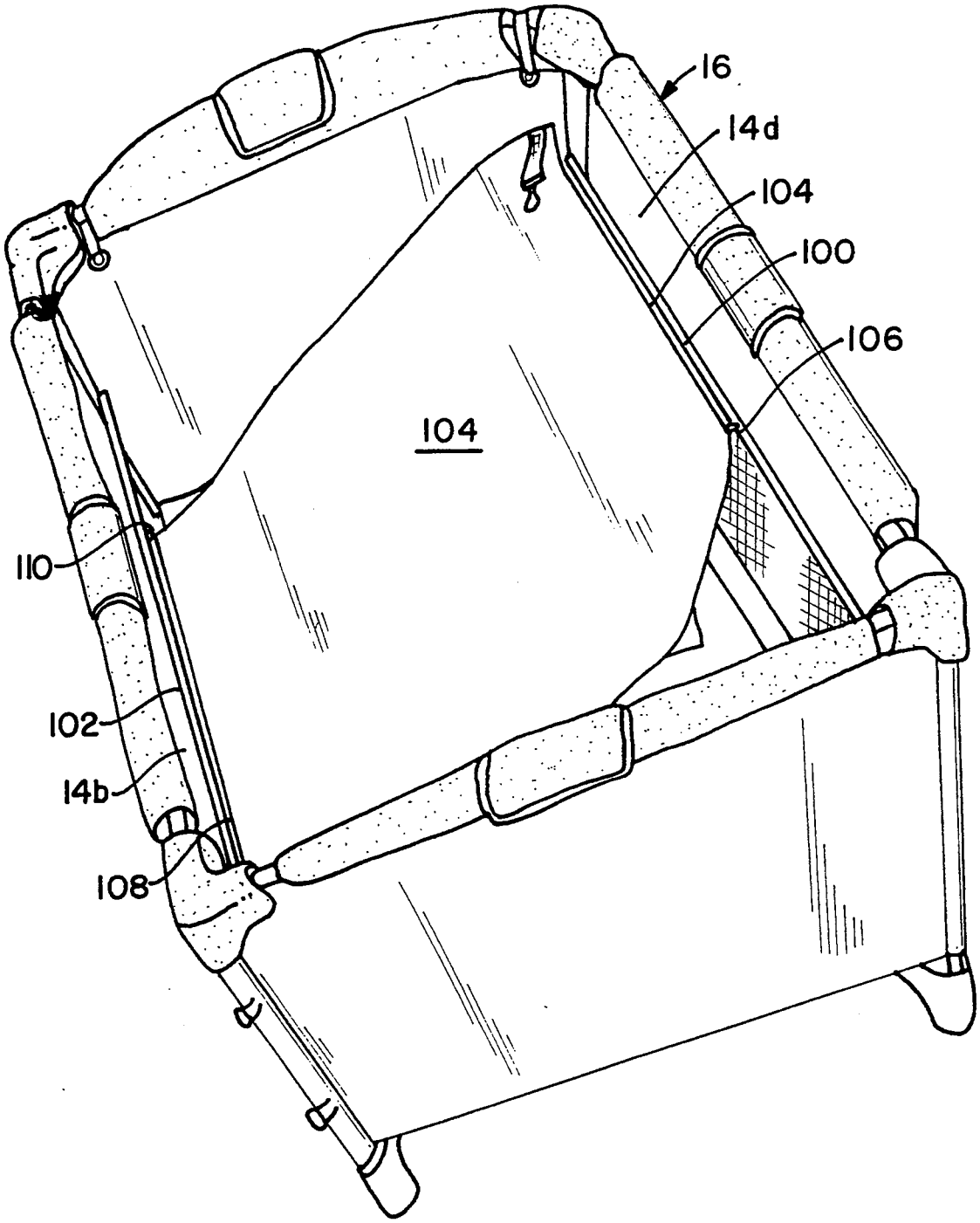
FIG. 7 is a perspective view similar to FIG. 6, showing the fabric support for the dressing/changing table being secured to fabric side panels of the playpen.
Figure 8:
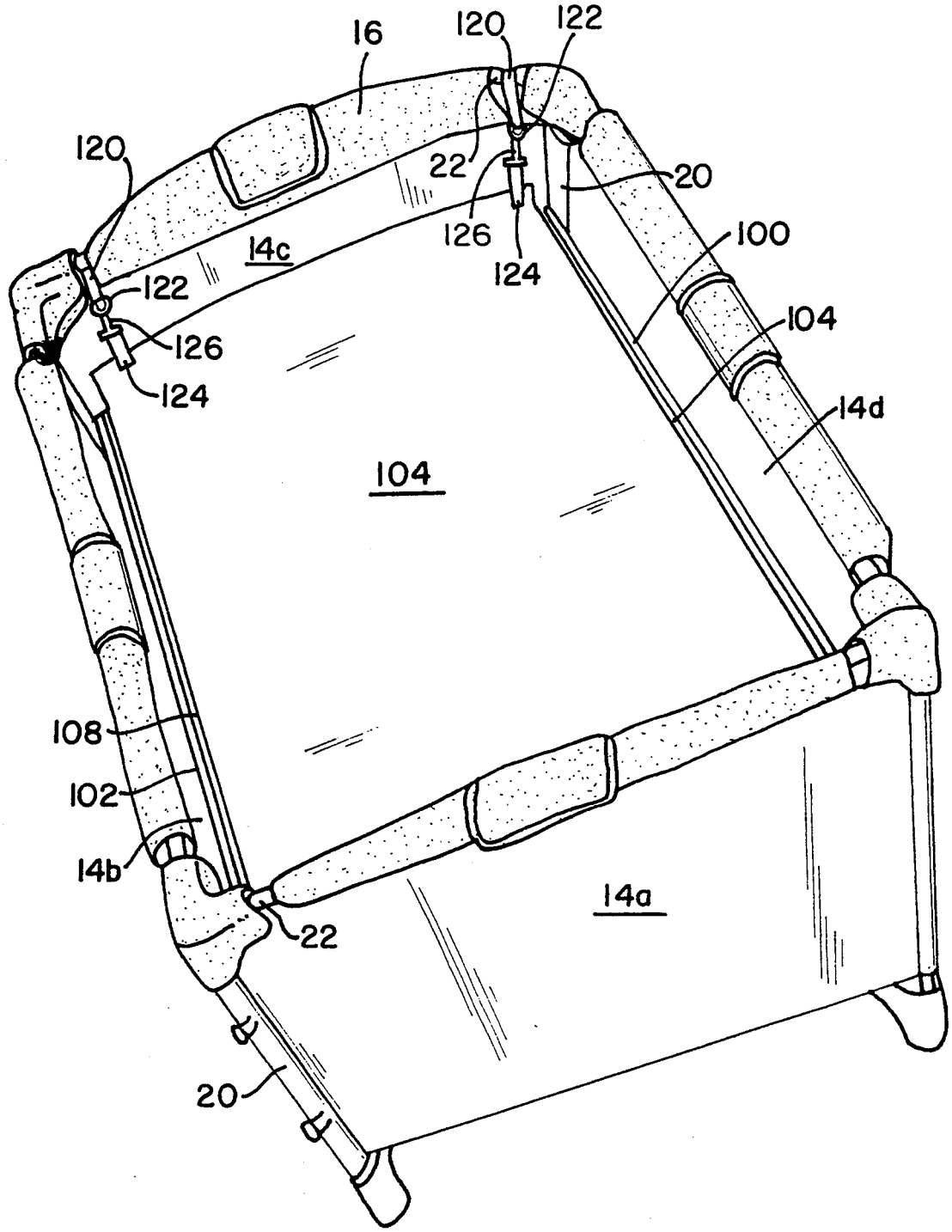
FIG. 8 is a perspective view similar to FIG. 7, showing the fabric support fully secured to and suspended within the interior of the playpen.

In accordance with the present invention, and referring to FIG. 6, a first row of zipper teeth 100 is secured horizontally along fabric side panel 14*d* and a second set of interlocking zipper teeth 102 is secured horizontally along the opposite fabric side panel 14*b*. First and second sets 100 and 102 of zipper teeth are provided at the same level, which is below upper frame assembly 16.

A supporting surface 104 in the form of a fabric having dimensions similar to the inner dimensions of the formed playpen, includes a first row of interlocking zipper teeth 100 at one edge thereof along with a slide fastener 106 slidable along the interlocking zipper teeth 100 for interlocking the first rows 100 and 102 of zipper teeth together. In like manner, the opposite side of supporting fabric 104 includes a second set 108 of interlocking zipper teeth and a slide fastener 110 slidable there along for interlocking the second sets 102 and 108 of zipper teeth together. In this manner, supporting fabric 104 can be releasably secured between opposite fabric side panels 14*b* and 14*d* by the aforementioned zipper arrangements.

It will be appreciated that first and second sets 100 and 102 of teeth are arranged horizontally along fabric side panels 14*d* and 14*b*, respectfully and at a height slightly below upper frame assembly 16. In this manner, when fabric support 104 is stretched and secured between fabric side panels 14*b* and 14*d*, the upper surface of fabric support 104 is positioned below upper frame assembly 16 so as to prevent a small child from falling from fabric support 104 if left unattended for a short period of time. In other words the portion of side panels 14*a*–14*d* above fabric support 104, along with upper frame assembly 16, form a guard rail assembly to prevent escape by the infant.

As shown in FIGS. 6–9, in order to further secure fabric support 104 at the desired height in the playpen, retaining straps 120 are formed at opposite ends of collapsible upper rails 22 immediately above side panels 14*a* and 14*c*. A ring 122 is secured to the free hanging end of each retaining strap 120. Straps 124 are secured to opposite ends of the remaining two sides of fabric support 104 and include releasable clip assemblies 126 for releasable securement with respective rings 122. This provides additional securement of fabric support 104. It will be appreciated that the aforementioned straps 120, 124, rings 122 and clip assemblies 126 may be used alternatively and/or in addition to the aforementioned zipper arrangement.

Figure 9:
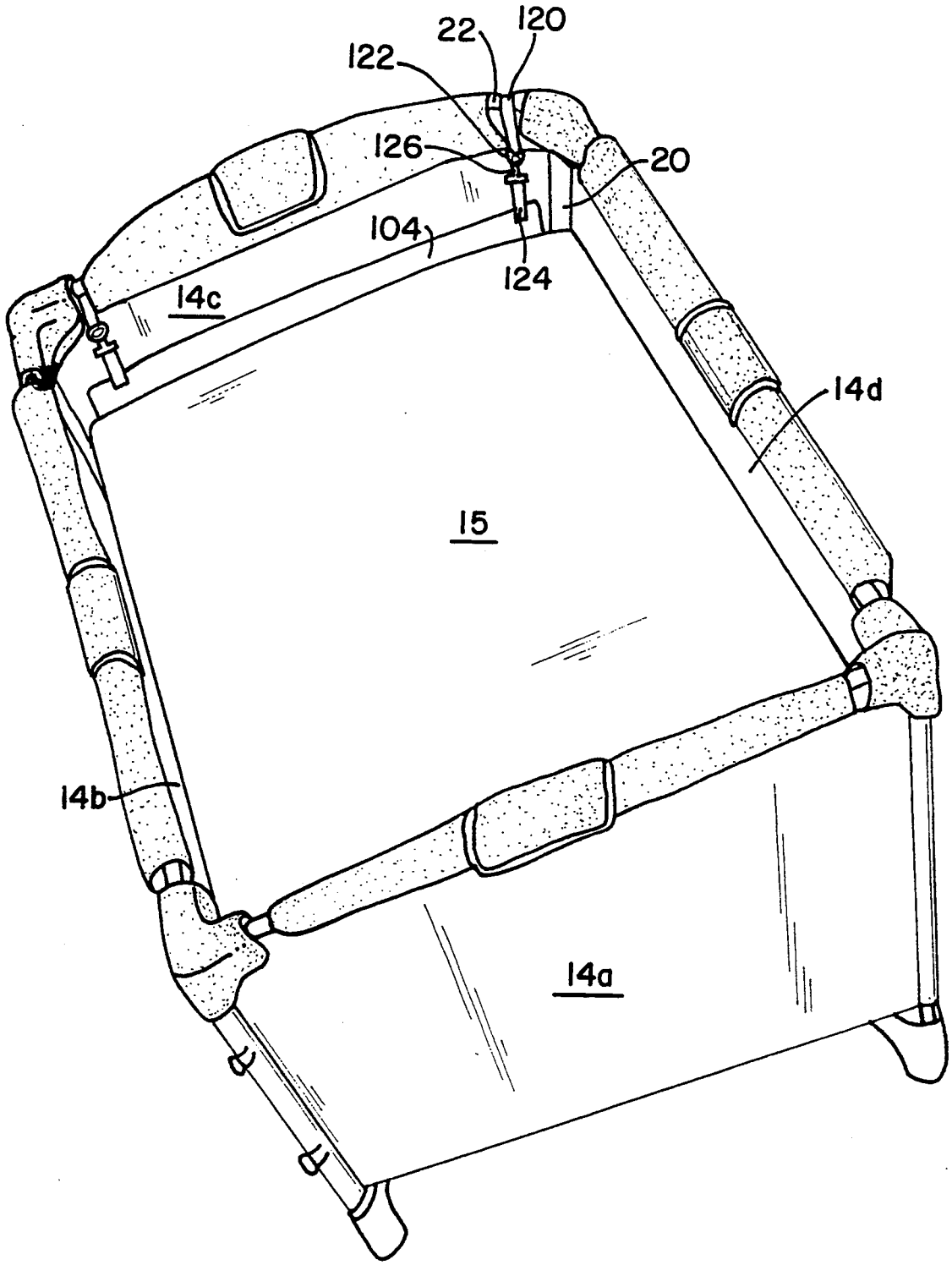
FIG. 9 is a perspective view similar to FIG. 8, showing the foldable floor mat positioned on the fabric support.

Once fabric support 104 is secured in the manner described above, foldable floor mat 15 can be placed thereon, as shown in FIG. 9 to provide a soft cushion surface for the infant.

It will be appreciated that, although the aforementioned strap assemblies and zipper assemblies have been shown for securing fabric support 104 to the playpen, any other suitable means may be provided. For example, straps 120 can be secured to corner legs 20.

Figure 10:
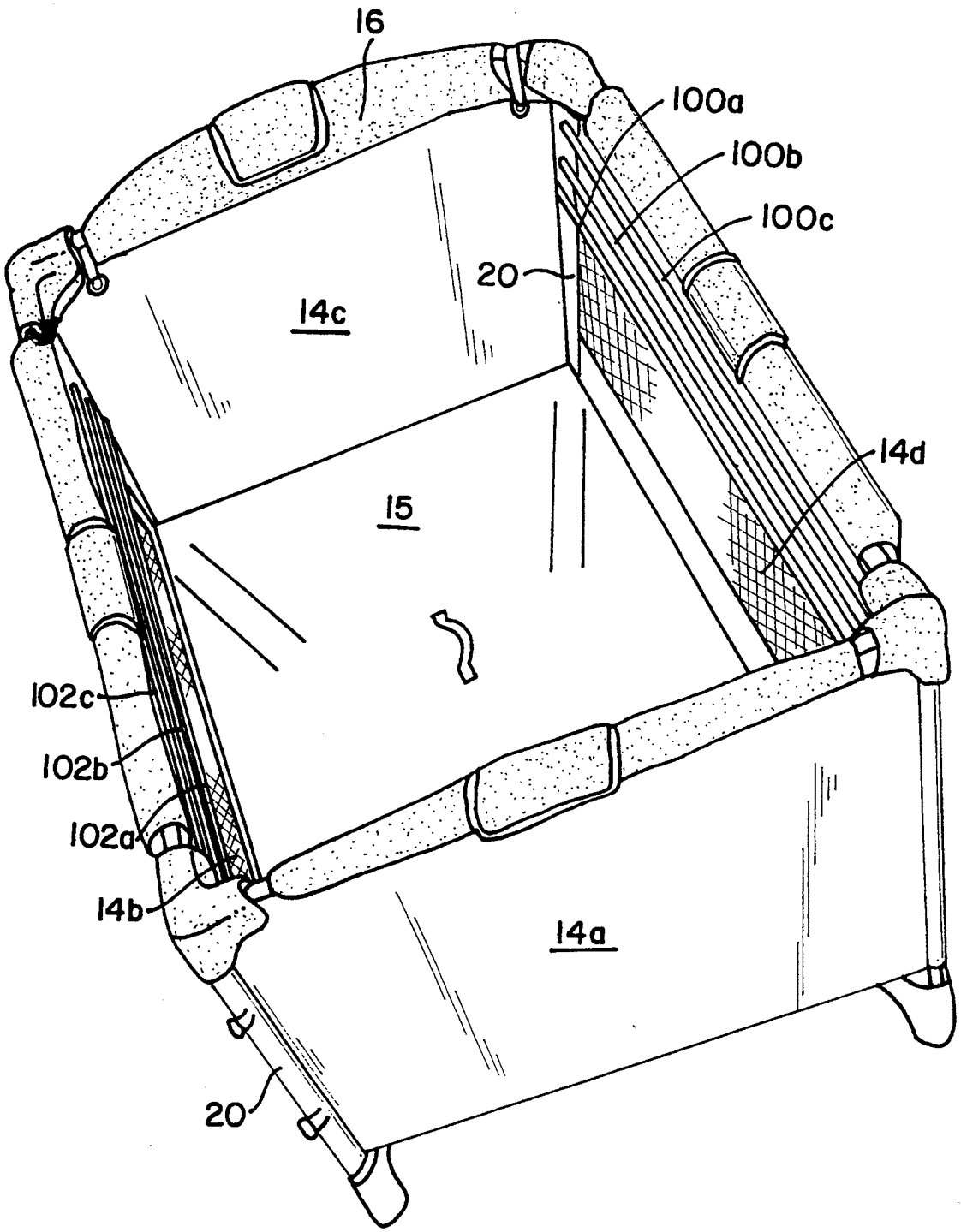
FIG. 10 is a perspective view similar to FIG. 6, showing a modification for adjusting the fabric support at different heights.

Further, as shown in FIG. 10, a plurality of first rows 100*a*, 100*b* and 100*c* of interlocking zipper teeth can be provided along fabric side panel 14*d* and a corresponding number of second rows 102*a*, 102*b* and 102*c* of interlocking gear teeth can be provided along fabric side panel 14*b* at different heights to provide adjustability with respect to the height of fabric support 104.

It will therefore be appreciated that the present invention provides a foldable, and thereby transportable playpen that can be easily converted into a dressing/-changing table for a child. Further, such a dressing/-changing table is safe to use since the fabric support 104 is positioned at a sufficiently lower height below upper frame assembly 16.

Having described specific preferred embodiments of the invention with reference to the accompanying drawings, it should obvious that the present invention is not limited to those precise embodiments and that various changes and modifications can be effected therein by one of ordinary skill in the art without departing from the scope or spirit of the invention as defined by the appended claims.

What is claimed is:

1. A combination playpen and dressing/changing table, comprising:

a) a frame including:

i) an upper frame assembly;

ii) a lower frame assembly, iii) a plurality of corner legs, each leg having an upper end and a lower end, and iv) connecting means for interconnecting said upper frame assembly to the upper ends of said corner legs and for interconnecting said lower frame assembly to the lower ends of said corner legs;

b) a fabric enclosure secured to said frame to define a bottom and sides of said playpen;

c) supporting surface means for supporting an infant thereon, said supporting surface means consisting essentially of a planar sheet having opposite sides with zipper means thereon; and d) securing means for removably securing said supporting surface means between opposite sides of said playpen such that said supporting surface means is positioned above said bottom and below said upper frame assembly, said securing means including zipper means, secured on two inner opposite sides of said fabric enclosure at a position above said bottom and below said upper frame assembly, for interlockingly engaging with said zipper means of said supporting surface means to secure two opposite sides of said supporting surface means to said fabric enclosure such that said supporting surface means is positioned above said bottom and below said upper frame assembly.

2. A combination playpen and dressing/changing table according to claim 1, wherein said supporting surface means includes a fabric support having a shape similar to that of said frame and having dimensions slightly less than said frame so as to fit therein.

3. A combination according to claim 2, wherein said zipper means includes first and second rows of interlocking teeth along two opposite sides of said fabric support and third and fourth interlocking rows of teeth secured to two opposite sides of said fabric enclosure for interlocking engaging with said first and second rows of teeth, respectively.

4. A combination playpen and dressing/changing table, comprising:

a) a frame including:

i) an upper frame assembly, ii) a lower frame assembly, iii) a plurality of corner legs, each leg having an upper end and a lower end, and iv) connecting means for interconnecting said upper frame assembly to the upper ends of said corner legs and for interconnecting said lower frame assembly to the lower ends of said corner legs;

b) a fabric enclosure secured to said frame to define a bottom and sides of said playpen;

c) supporting surface means for supporting an infant thereon, said supporting surface means including a fabric support having a shape similar to that of said frame and having dimensions slightly less than said frame so as to fit therein; and d) securing means for removably securing said supporting surface means between opposite sides of said playpen such that said supporting surface means is positioned above said bottom and below said upper frame assembly, said securing means including zipper means for securing at least two opposite sides of said fabric support to said fabric enclosure, said zipper means including first and second rows of interlocking teeth along two opposite sides of said fabric support and third and fourth interlocking rows of teeth secured to two opposite sides of said fabric enclosure for interlockingly engaging with said first and second rows of teeth, respectively, and said zipper means including a plurality of said rows of interlocking teeth secured to said two side panels of said fabric enclosure at different heights to enable securement of said fabric support at different heights.

5. A combination playpen and dressing/changing table, comprising:

a) a frame including:

i) an upper frame assembly, ii) a lower frame assembly, iii) a plurality of corner legs, each leg having an upper end and a lower end, and iv) connecting means for interconnecting said upper frame assembly to the upper ends of said corner legs and for interconnecting said lower frame assembly to the lower ends of said corner legs;

b) a fabric enclosure secured to said frame to define a bottom and sides of said playpen;

c) supporting surface means for supporting an infant thereon; and d) securing means for removably securing said supporting surface means between opposite sides of said playpen such that said supporting surface means is positioned above said bottom and below said upper frame assembly, said securing means including strap means for securing said supporting surface means to one of said upper frame assembly and said corner legs.

6. A combination according to claim 5, wherein said strap means includes a plurality of first straps secured to one of said upper frame assembly and said corner legs, a second set of straps secured to opposite edges of said supporting surface means, and means for releasably securing free ends of said first and second sets of straps together.

* * * * *